US005293907A

United States Patent [19]

Tamura

[11] Patent Number: 5,293,907

[45] Date of Patent: Mar. 15, 1994

[54] LOOM SPEED CONTROLLER RESPONSIVE TO FILLING YARN CHARACTERISTICS

[75] Inventor: Zenji Tamura, Kanazawa, Japan

[73] Assignee: Tsudakoma Kogyo Kabushiki Kaisha, Kanazawa, Japan

[21] Appl. No.: 943,562

[22] Filed: Sep. 11, 1992

[30] Foreign Application Priority Data

Sep. 19, 1991 [JP] Japan ..... 3-239766

[51] Int. Cl.[5] ..... D03D 51/34

[52] U.S. Cl. ..... 139/1 E; 364/470; 364/921.1; 139/453

[58] Field of Search ..... 139/1 E, 1 R, 450, 453, 139/435.1; 364/470, 921.1

[56] References Cited

FOREIGN PATENT DOCUMENTS 2522029 8/1983 France .
229848 9/1989 Japan ..... 139/1 E
2-00846 8/1990 Japan ..... 139/1 E
2117137 5/1983 United Kingdom .

*Primary Examiner*—Andrew M. Falik
*Attorney, Agent, or Firm*—Oblon, Spivak, McClelland, Maier & Neustadt

[57] ABSTRACT

A loom speed controlling apparatus includes a counter adapted to output a current pick number, a data memory for storing the maximum allowable loom speed values depending upon physical characteristics of various filling yarns in correlation with pick numbers, and a discriminator for determining a target rotational speed of a driving motor for the loom in accordance with the current pick number supplied from the counter and data supplied from the data memory. An indexing signal generator is connected to an input of the counter and an inverter for variable-speed operation of the loom driving motor is connected to an output of the discriminator and the index signal generator includes a plurality of proximity switches adapted to be disposed close to a loom spindle and the indexing signal generator.

7 Claims, 8 Drawing Sheets 10
13
Data Setting Unit
D
12
Data Memory
Pn2
15
Comparator
11
Discriminating Means
N
Sn
Yi
Sy
AC
INV
M
WF
Multi-color Filling Device
14
Counter
R
U
D
P
Sp1
Sp2
20
22
Indexing Signal Generator
21a
21b
MS1
MS

Fig. 3

Data D

| Region number | Minimum pick number | Maximum pick mumber | Filling yarn type | Maximum allowable speed |
|---|---|---|---|---|
| 1 | $p_{11}$ | $p_{12}$ | $Y_1$ | $N_1$ |
| 2 | $p_{21}$ | $p_{22}$ | $Y_2$ | $N_2$ |
| ⋮ | ⋮ | ⋮ | ⋮ | ⋮ |
| i | $p_{i1}$ | $p_{i2}$ | $Y_i$ | $N_i$ |
| ⋮ | ⋮ | ⋮ | ⋮ | ⋮ |
| n | $p_{n1}$ | $p_{n2}$ | $Y_n$ | $N_n$ |

T

LOOM SPEED CONTROLLER RESPONSIVE TO FILLING YARN CHARACTERISTICS

BACKGROUND OF THE INVENTION

1. Field of the Invention

The present invention relates to an apparatus for controlling the operating speed of a loom having a multi-color filling function, which is capable of selecting the optimum rotational speed according to each type of filling or weft insertion of yarn for improvement of loom productivity. More particularly, the invention relates to an apparatus for controlling the operating speed of a loom according to each type of filling yarn taking into consideration the maximum allowable loom speed depending on the ease of breakage of the yarn or the ease of flying of the yarn on an air jet loom or a water jet loom. More particularly, the invention relates to a loom speed controlling apparatus which insures filling at a relatively low speed according to the ease of breakage or the difficulty of flying of the filling yarn and at a relatively high speed according to the difficulty of breakage or the ease of flying of the yarn.

2. Description of the Related Art

While the operating speed of a loom is limited by a variety of factors, the factor which is often decisive in multicolor filling is the physical characteristics of the filling yarns employed. This is because the yarn which is low in tensil strength and, hence, easy to break cannot be used advantageously a the filling in weaving unless the filling speed is properly restrained. In the case of an air jet loom or a water jet loom, there are yarns which are difficult to fly and those which are easy to fly, and compared with the latter, the former cannot be woven at a high filling speed.

Therefore, when a yarn of high tensil strength and a yarn of low tensile strength are used together as the filling and/or a yarn which is difficult to fly and a yarn which is easy to fly are used as the filling in multi-color filling, the loom speed is generally dependent on the yarn of the lowest tensile strength and/or the most difficult to fly, that is to say the yarn which cannot be woven unless the lowest filling or weft inserting speed is employed. There has not been available a system which would pay heed to the physical properties of various yarns and positively control the operating speed of the loom.

From the standpoint of productivity enhancement, the conventional technology is not reasonable in that excepting the case in which the current weaving run involves a filling yarn calling for a low filling or weft inserting speed either entirely or predominantly, there is sizable room for loom speed when the weaving job involves the use of other types of yarns in large proportions. In other words, since multi-color filling employs a variety of yarns in sequence to give a predetermined weave pattern, operating a loom at a constant speed throughout the job means an operation of the loom with much speed to spare when the loom is weaving yarns which are difficult to break or easy to fly.

It is an object of the present invention to provide a loom speed controlling apparatus which determines and outputs the target rotational speeds of the loom spindle driving motor, as well as the takeup and other drive motors to be synchronized therewith, in association with the physical characteristics of the respective filling yarns and enables filling or weft insertion at speeds dependent on said target speeds, thereby insuring the highest possible productivity.

It is another object of the present invention to provide a loom speed controlling apparatus which insures accurate setting of target rotational speeds according to input signals and stored data for exact loom speed control.

SUMMARY OF THE INVENTION

The first invention disclosed in this application, designed to accomplish the above objects, is directed to a loom speed controller comprising a counter adapted to output the current pick number, a data memory storing the maximum allowable loom speed values depending on physical characteristics of various filling yarns in association with pick numbers, and a discriminating means for determining a target rotational speed of a loom driving motor according to the current pick number supplied from said counter and data supplied from said data memory.

The second invention similarly disclosed in this application is directed to a loom speed controller comprising a data memory storing the maximum allowable loom speed values in association with types of various filling yarns and a discriminating means for determining the maximum allowable speed value from said data memory as the target speed of the driving motor in response to an external filling yarn selection signal.

In accordance with the first invention, the counter is adapted to count pick numbers with the progress of loom operation to sequentially output the current pick number and the data memory can store the maximum allowable loom speeds dependent on physical characteristics of filling yarn in association with pick numbers. Based on the current pick number supplied from the counter and the data from the data memory, the discriminating means can determine a target speed for a loom driving motor so that the operating speed of the loom may agree with the current maximum allowable speed value which is dependent on the physical caracteristic of the filling yarn corresponding to the current pick number. Thus, throughout the entire weaving process, the loom may be driven at rotational speeds corresponding to the maximum allowable speed values at respective moments.

In accordance with the second invention, a filling yarn selection signal from a multi-color filling device including such as an electric dobby is fed to a data memory which, in turn, outputs the maximum allowable speed value for the filling yarn type designated by said filling yarn selection signal. By utilizing this maximum allowable speed value as the target speed value, the discriminating means performs optimized control of loom speed as in the first invention.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

BRIEF DESCRIPTION OF THE DRAWINGS

FIG. 3 is a table showing stored data;

DESCRIPTION OF THE PREFERRED EMBODIMENTS

Preferred embodiments of the present invention are now described with reference to the accompanying drawings.

Figure 1:
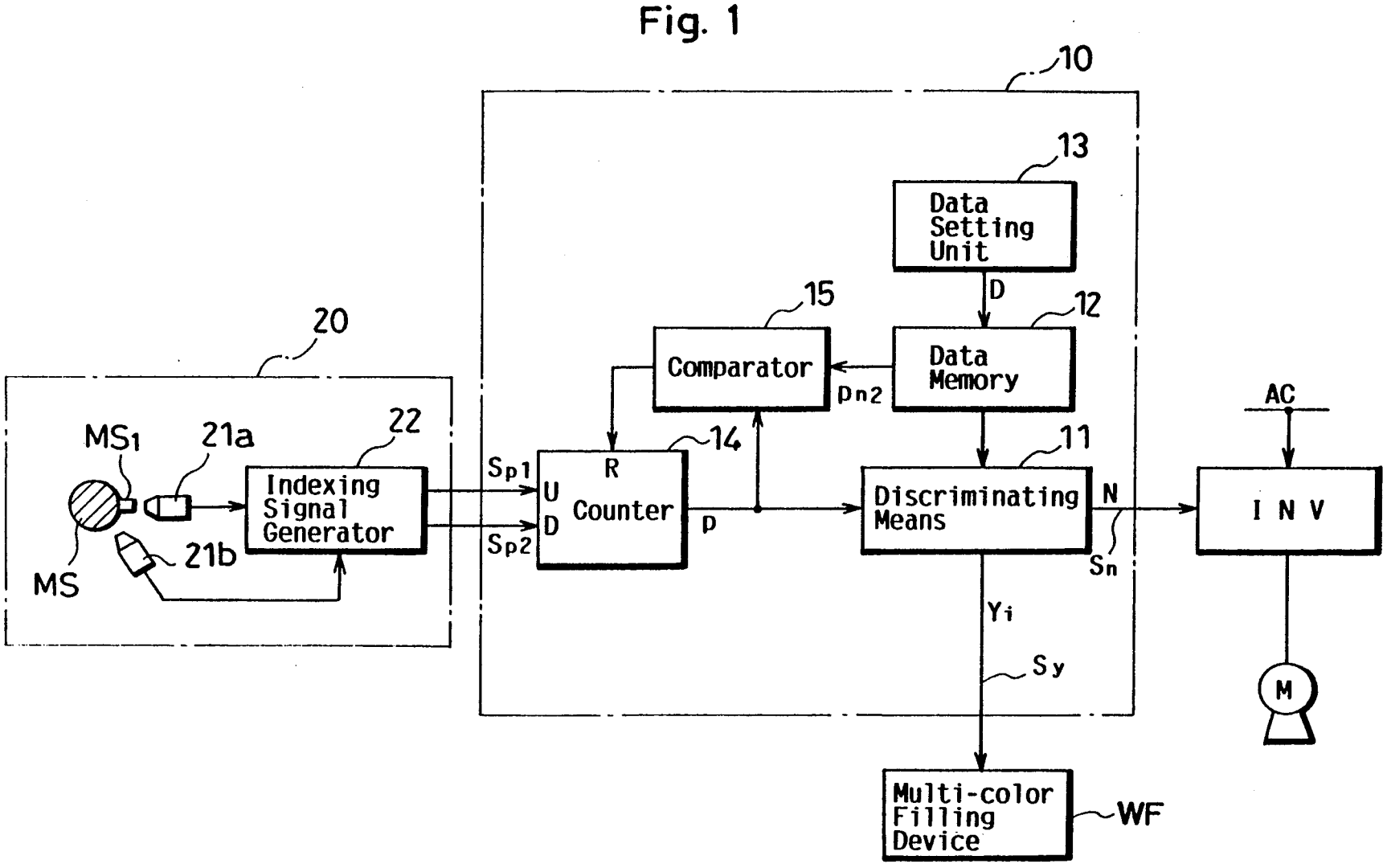
FIG. 1 is a block diagram of the entire system.

An apparatus for controlling the operating speed of a loom (hereinafter referred to briefly as a controller) 10 essentially comprises a discriminating means 11, a data memory 12 and a counter 14 (FIG. 1), and is interposed between an indexing signal generating means 20 and an inverter INV for variable speed drive of a loom driving motor M.

The indexing signal generating means 20 comprises a couple of proximity switches 21a and 21b disposed adjacent a main drive shaft of the loom MS and has an indexing signal generator 22. Thus, the proximity switches 21a and 21b are respectively disposed in face-to-face relation with an operative member MS1 projecting from the main drive shaft MS of the loom and the output signals of the switches are fed to the indexing signal generator 22 so that a normal rotation pulse signal Sp1 and a reverse rotation pulse signal Sp2 are available from the indexing signal generator 22. It should be understood that said normal rotation pulse signal Sp1 and reverse rotation pulse signal Sp2 are outputted upon every single revolution of the main drive shaft MS while the loom is running in the normal rotational direction and reverse rotational direction, respectively.

The controller 10 has, in addition to said discriminator 11, data memory 12 and counter 14, a data setting means 13 and a comparator 15.

The counter 14 inputs the normal rotation pulse signal Sp1 and reverse rotation signal Sp2 from said indexing signal generating means 20 to an up terminal U and a down terminal D, respectively, and the output of the counter 14 is fed to the discriminator 11 and comparator 15 as the current pick number p.

The output terminal of the data setting means 13 is connected to said discriminator 11 via said data memory 12, while one output of the discriminating means 11 is fed to the inverter INV as a target speed signal Sn representing the target rotational speed N of the driving motor M. The other output of the discriminating means 11 is fed to a multi-color filling device WF as a filling yarn selection signal Sy representing the yarn type Yi of the filling to be supplied. The multi-color filling device WF employs a filling mechanism not shown and performs filling or weft insertion with the yarn designated by the filling yarn selection signal Sy at a predetermined timing.

Connected to the comparator 15 is another output of the data memory 12 and the output terminal of the comparator 15 is connected to a reset terminal R of the counter 14.

The driving motor M is a loom driving motor not shown in greater detail. This motor M is connected to an AC supply through the inverter INV and driven at variable speed by the inverter INV.

Figure 2:
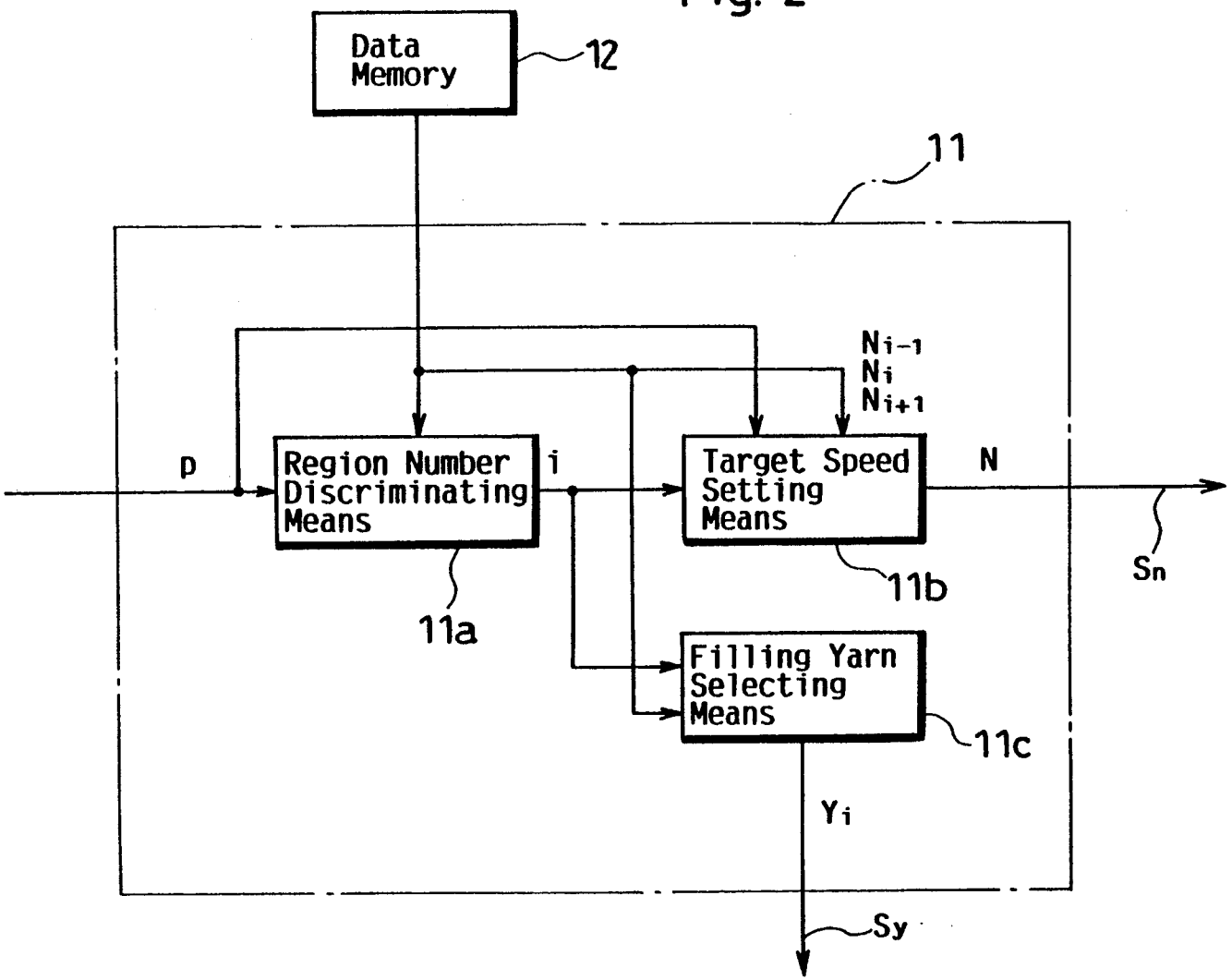
FIG. 2 is a block diagram of the principal part of the system.

The discriminating means 11 comprises a region number discriminator 11a, a target speed setting means 11b and a filling yarn selecting means 11c (FIG. 2).

The region number discriminating means 11a is supplied with the pick number p from the counter 14 and is connected to the output terminal of the data memory 12. The output of the region number discriminator 11a as well as the output of the data memory 12 is connected to the target speed setting means 11b and filling yarn selecting means 11c. The pick number p from the counter 14 is also fed to the target speed setting means 11b. The outputs of the target speed setting means 11b and filling yarn selecting means 11c are taken out as target speed signal Sn and filling yarn selection signal Sy, respectively.

The actions of the controller 10 are now described.

First, data D set through the data setting means 13 are stored en bloc in the data memory 12 (FIG. 3).

Data D includes the filling yarn types Yi (i=1, 2 . . . n) corresponding to the minimum pick numbers pi1 (i=1, 2 . . . n) and maximum pick numbers pi2 (i=1, 2 . . . n) classified by region numbers i (i=1, 2 . . . n) and the corresponding maximum allowable speeds Ni (i=1, 2 . . . n). Here, the region number i is a number representing the region of No.i within one repeat range T (hereinafter referred to as 1 repeat) of the filling yarn selection pattern where the pick number p satisfies the relation $p11 \leqq p \leqq pn2$, and the minimum pick number pi1 and maximum pick number pi2 are pick numbers representing the boundaries of the region corresponding to region number i. The filling yarn type Yi represents the filling yarn to be supplied in the region corresponding to region number i and the maximum allowable speed Ni represents the maximum allowable rotational speed of a loom which is dependent on the designated filling yarn type Yi. It should be understood that, in FIG. 3, $p11=1$, $pi1=p(i-1)2+1$.

The counter 14 is a reversible counter which inputs a normal rotation pulse signal Sp1 and a reverse rotation pulse signal Sp2 and its content represents the current pick number p within 1 repeat T. Thus, as the maximum pick number pn2 representing the maximum value of pick number p within 1 repeat T, which is among the data D entered through the data setting means 13, is fed from the data memory 12 to the comparator 15, the comparator 15 compares this maximum pick number pn2 with the current content of the counter 14 and, when the latter exceeds the former, compulsively initializes the content of the counter 14 to 1. Therefore, by counting the normal rotation pulse signals Sp1, the counter 14 may output the current pick number p within that repeat T. However, when the rotation of the loom is reversed for withdrawal of improper filling, for instance, the counter 14 counts down its content by 1 after 1 in response to the reverse rotation pulse signal Sp2 and, at $p<1$, is preset to $p=pn2$.

The discriminating means 11 receiving the current pick number p from the counter 14 designates the region number i corresponding to the particular pick number p and reads data D for the region number i from the data memory 12. Based on this data D, it determines the target speed N of the driving motor M and outputs this value N to the inverter INV. At the same time, the discriminating means 11 can specify the filling yarn type Yi and output the information to the multi-color filling device WF.

Thus, the region number discriminator 11a of said discriminating means 11, on receiving the pick number p from the counter 14, reads the minimum pick number pi1 and maximum pick number pi2 successively from the data memory 12, compares the pick number p with the minimum pick number pi1 and the maximum pick number pi2 to find a region where the pick number p satisfies the relation $pi1 \leqq p \leqq pi2$, and designates the region number i. Then, the filling yarn selecting means 11*c* refers to the data D stored in the data memory 12 to designate the filling yarn type Yi corresponding to the region number i and outputs a filling yarn selection signal Sy to the multi-color filling or weft insertion device wF.

Figure 4:
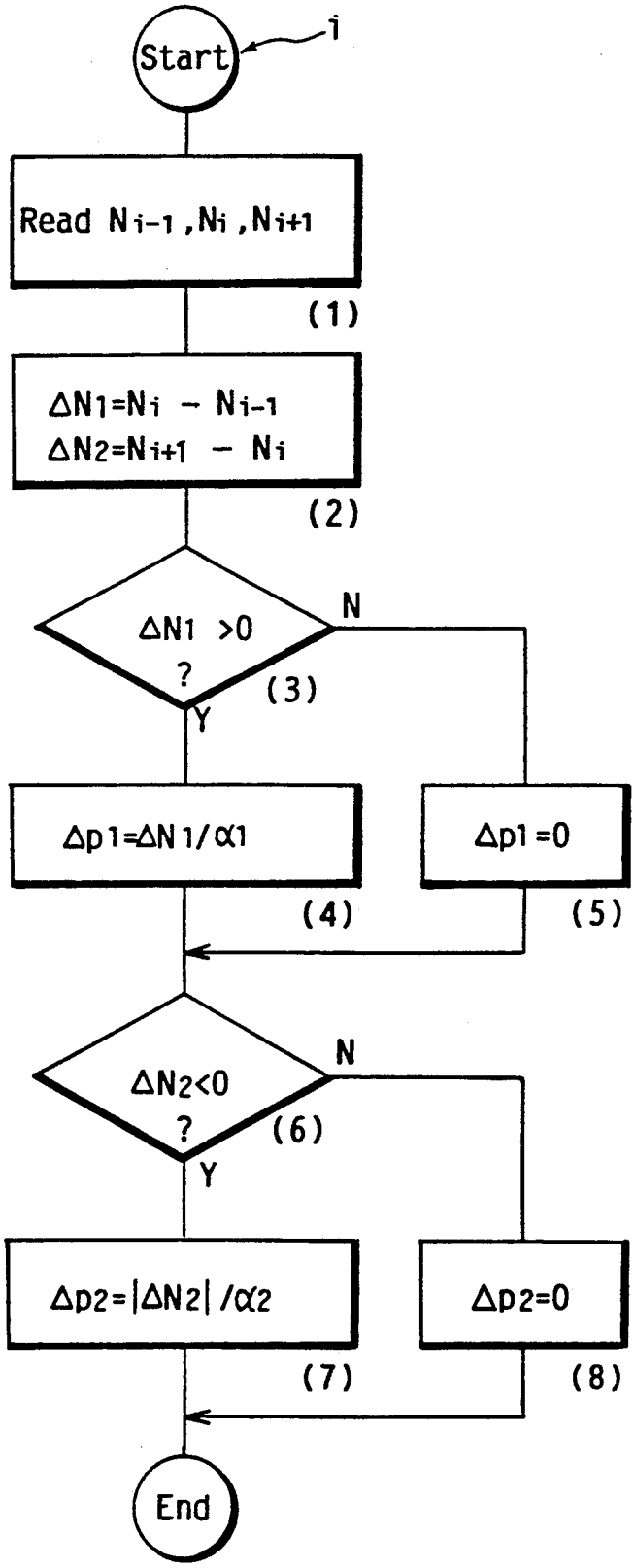
FIG. 4 is a program flow chart (1)
Figure 5:
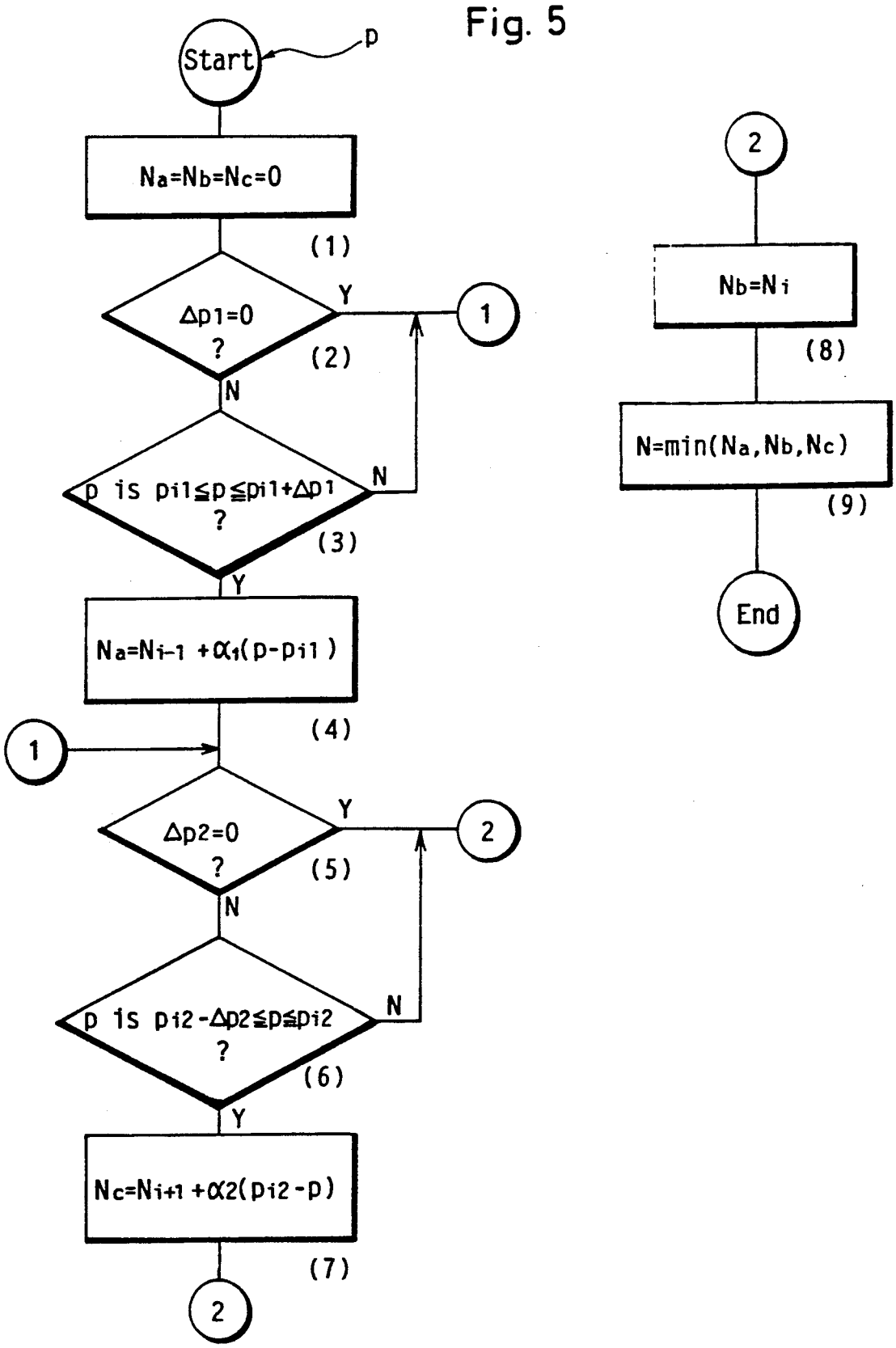
FIG. 5 is a program flow chart (2)

On the other hand, the target speed setting means 11*b* executes operations according to the program flow charts of FIGS. 4 and 5, respectively, every time the region number i from the region number discriminator 11*a* and the pick number p from the counter 14 are updated. However, when the region number i is updated simultaneously with updating of the pick number p, the target speed setting means 11*b* executes the program of FIG. 4 first and the program of FIG. 5 next.

As the region number i is updated, the program first reads from the data memory 12 the maximum allowable speed data Ni−1, Ni and Ni+1 corresponding to the region numbers (i−1), i, and (i+1), respectively, [step (1) in FIG. 4, hereinafter referred to briefly as (1)]. It should be understood that where i=n, i+1=1 and that where i=1, i−1=n.

Figures 6A, 6B, 6C:
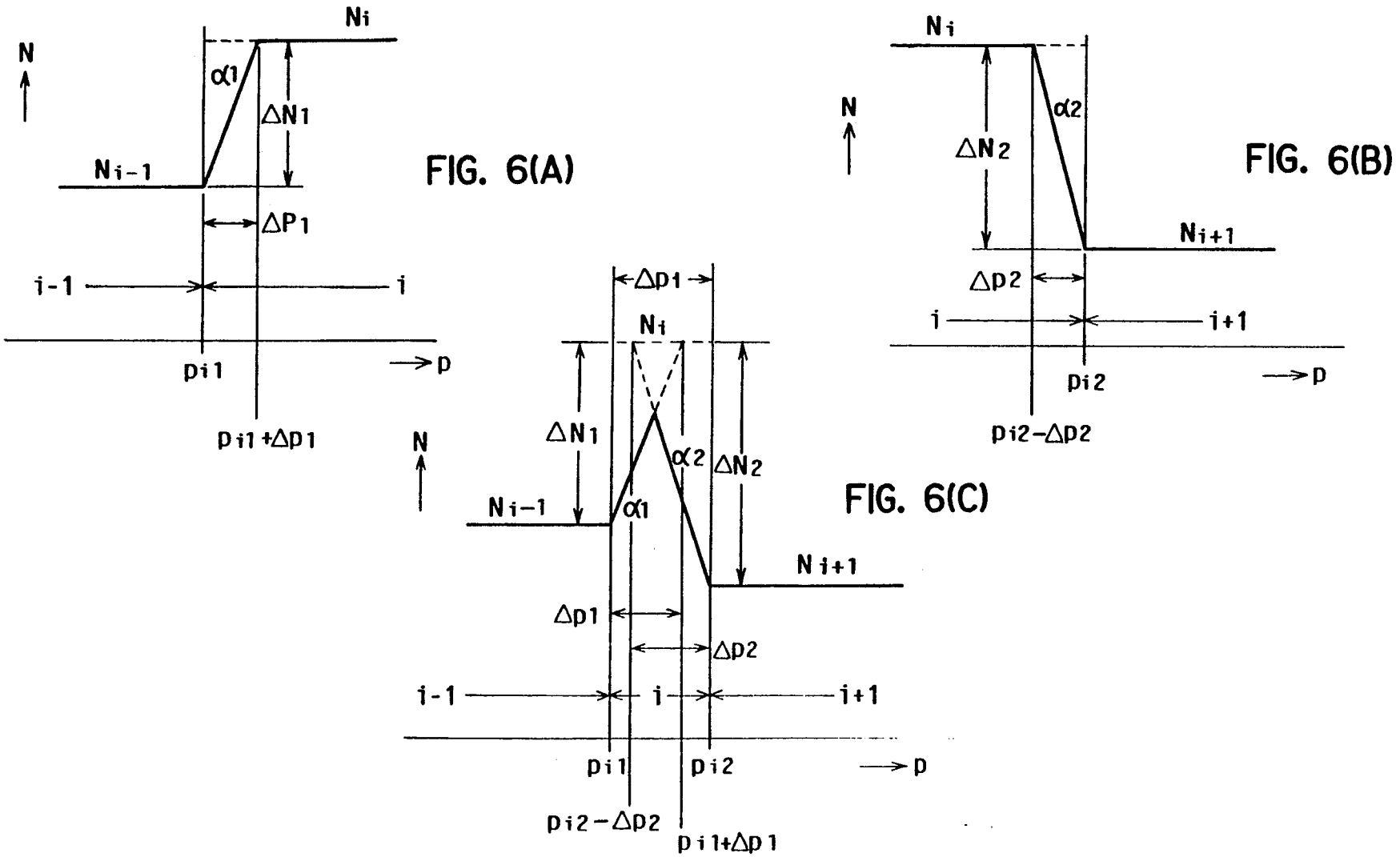
FIGS. 6a–c are schematic diagrams (1) for explaining the actions involved.

Then, the program computes $\Delta N1 = Ni - Ni-1$ and $\Delta N2 = Ni^{+1} - Ni$ (2), and where $\Delta N1 > 0$ (3), computes $\Delta p1 = \Delta N1/\alpha 1$ (4) or where it is not true that $\Delta N1 > 0$ (3), sets $\Delta p1 = 0$ (5). Here, $\Delta N1 > 0$ represents the case in which the maximum allowable speed increases from Ni−1 to Ni from the region number (i−1) preceding the current region number i to the region number i [FIG. 6 (A)] and in this case the program sets a transitional zone $\Delta p1$ for the target speed N of the driving motor M within the area of region number i from the starting point of the region. It is so arranged that the target speed N in the transitional zone $\Delta p1$ increases linearly with a gradient of $\alpha 1$ in relation to pick number p.

The program further computes $\Delta p2 = |\Delta N2/\alpha 2$ (7) where $\Delta N2 < 0$ (6) or sets $\Delta p2 = 0$ (8) where it is not true that $\Delta N2 < 0$ (6). Thus, where the maximum allowable speed decreases from Ni to Ni−1 from region number i to the next region number (i+1) [FIG. 6, (B)], the program sets a transitional zone $\Delta p2$ within the area of region number i towards the end of the region and the target speed N in the transitional zone $\Delta p2$ decreases linearly with a gradient of $\alpha 2$ in relation to pick number P.

Then, as the pick number p is updated, the target speed setting means 11*b* computes the target speed N of driving motor M corresponding to the new pick number p in accordance with the program flow chart shown in FIG. 5.

Thus, the program first sets provisional target speeds Na, Nb and Nc, then sets Na=Nb=Nc=0 [program step (1) in FIG. 5; hereinafter referred to briefly as (1)] and where $\Delta p1 \neq 0$ (2), confirms that the current pick number p is $pi1 \leqq p \leqq pi1 + \Delta p1$ and thus within the transitional zone $\Delta p1$ (3). Then, the program computes $Na = Ni-1 + \alpha 1\ (p - pi1)$ (4).

Then, where $\Delta p2 \neq 0$ (5), the program confirms that the pick number p is $pi2 - \Delta p2 \leqq p \leqq pi2$ and thus within the transitional zone $\Delta p2$ (6) and computes $Nc = Ni+1 + \alpha 2\ (pi2 - p)$ (7). If neither of them is true [(2), (3), (5), (6)], the program sets Nb=Ni (8).

By selecting the minimum values of provisional target speed Na, Nb and Nc thus computed, the program computes the target speed N as N=min (Na, Nb, Nc) (9), where N=min (Na, Nb, Nc) means the minimum value of Na, Nb, Nc, excluding zero. The target speed setting means 11*b* outputs the thus-determined target speed value N to the inverter INV as the target speed signal Sn. It should be understood in this connection that N=min (Na, Nb, Nc) is used as the target speed N because even when the breadth $\Delta pi = pi2 - pi1$ of the region corresponding to region number i is so narrow that there is a partial overlap of the transitional zones $\Delta p1$ and $\Delta p2$ [FIG. 6, (c)], the target speed N may continue uninterrupted (the solid line in the same figure).

Figure 7:
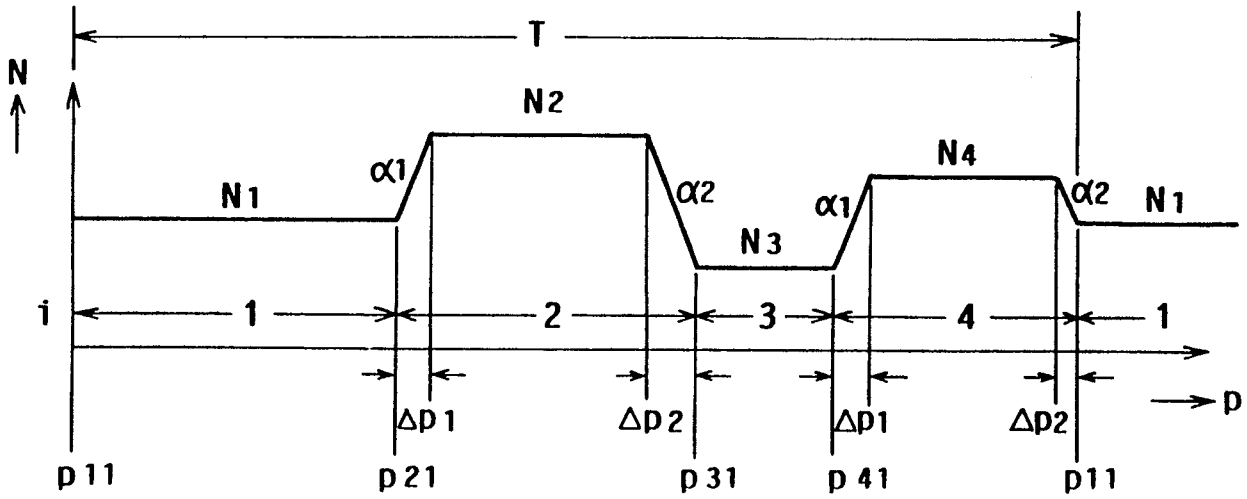
FIG. 7 is a schematic diagram (2) for explaining the actions involved.

In this manner, the target setting means 11*b* may output to the inverter INV the target speed value N based on the allowable maximum speed Ni for the region number i with the progress of weaving. Moreover, as to the transitional courses of the target speed value N, the transitional zones $\Delta p1$ and $\Delta p2$ can be established within the region where the maximum allowable speed value Ni is larger (FIG. 7). In other words, the loom can be operated with the highest possible efficiency. It should be understood that FIG. 7 shows an exemplary case in which n=4 and four kinds of filling or weft insertion were supplied during 1 repeat T.

Regarding the gradients $\alpha 1$ and $\alpha 2$ of target speed N in the transitional zones $\Delta pl$ and $\Delta p2$ in the above description, the maximum allowable limit values can be employed generally with reference to the follow-up response characteristics of the driving motor (M) speed control system, filling air pressure control system, filling time control system, and warp tension control system. Of course, the gradients $\alpha 1$ and $\alpha 2$ may be equal, viz. $\alpha 1 = \alpha 2$. Moreover, in order to improve the response characteristics of said various control systems, it may be so arranged that when $\Delta N1 > 0$ or $\Delta N2 < 0$ is detected, the target speed setting means 11*b* applies some predetermined in-advance control to them.

When the breadth $\Delta pi$ of the region corresponding to region number i is extremely narrow, the respective control systems cannot respond successfully even if the corresponding maximum allowable speed Ni is large. Therefore, the target speed N for this region should be limited to the value determined by the preceding and following maximum allowable speeds Ni−1 and Ni+1. The program flow chart of FIG. 5 determines the target speed N through N=min (Na, Nb, Nc) and, as such, can successfully cope with such a situation.

The target speed N in each transitional zone $\Delta p1$ or $\Delta p2$ may be varied drawing an optional continuous curve instead of being varied linearly.

The following description pertains to another embodiment of the present invention.

Figure 8:
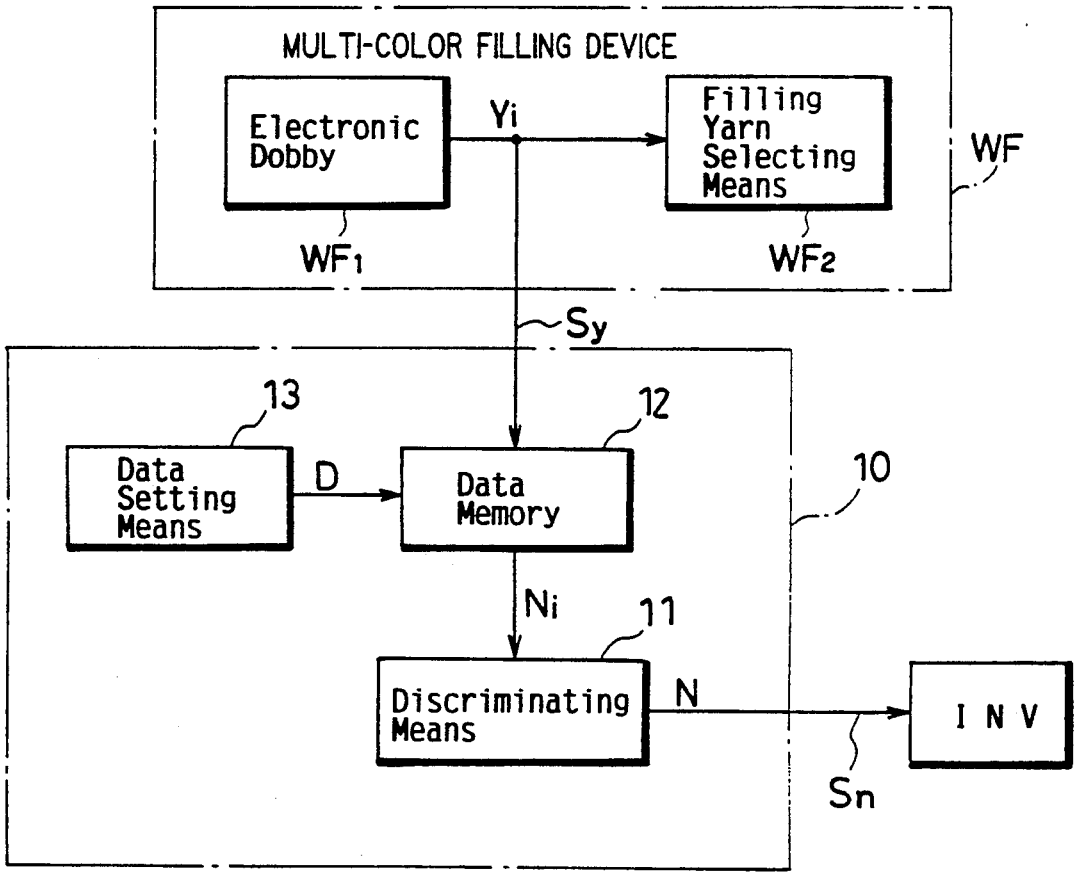
FIG. 8 is a block diagram of the principal part of another embodiment.

The data memory 12 can store only the maximum allowable speed values Ni for various filling yarn types Yi as data D. The controller 10 in this embodiment has this data memory 12 directly connected to the discriminating means 11 (FIG. 8) and the data memory 12 receives a filling yarn selection signal Sy from the multicolor filling device WF which comprises an electronic dobby WF1 and a filling yarn selecting means WF2.

The electronic dobby WF1 designates the yarn type Yi of the filling yarn to be supplied with the progress of weaving and transmits this designation to the filling yarn selecting means WF2 by way of a filling yarn selection signal Sy. The filling yarn selecting means WF2 accordingly selects the proper yarn for filling. On the other hand, the data memory 12 outputs to said discriminating means 11 the maximum allowable speed value Ni corresponding to the yarn type Yi designated via the filling yarn selection signal Sy and the discriminating means 11, in turn, determines the target speed N=Ni and outputs a target speed signal Sn to the inverter INV. In this embodiment, the transitional zones Δpl and Δp2 cannot be established but the loom can be operated with the highest processible efficiency a in the preceding embodiment.

Thus, the first invention disclosed in this specification comprises a counter adapted to indicate the current pick number, a data memory storing the maximum allowable loom speed values for various filling yarn types in correlation with pick numbers, and a discriminating means for determining the target speed of a driving motor as described and is of great value in that because said discriminating means can determine target speeds of the loom according to the maximum allowable speeds for various filling yarn types, a marked enhancement of productivity over the prior art can be realized through positive variation of the loom speed according to yarn types instead of the conventional weaving scheme of operating the loom at a constant speed compatible with the filling yarn which is the easiest to break and/or the most difficult to fly.

The second invention is advantageous in that substantially the same performance as the first invention can be obtained with the simplest possible loom control system construction.

I claim:

1. A loom speed controlling apparatus, which comprises:

a counter adapted to output a current pick number, a data memory for storing the maximum allowable loom speed values depending on physical characteristics of various filing yarns in correlation with pick numbers, and a discriminating means for determining a target rotational speed of a driving motor for a loom according to the current pick number supplied from said counter and data supplied from said data memory.

2. A loom speed controlling apparatus according to claim 1 wherein an indexing signal generating means is connected to an input of said counter and an inverter for variable-speed operation of said loom driving motor is connected to an output of said discriminating means.

3. A loom speed controlling apparatus according to claim 2 wherein said indexing signal generating means comprises a plurality of proximity switches adapted to be disposed close to a loom spindle and the indexing single generator.

4. A loom speed controlling apparatus according to claim 1 wherein said discriminating means includes a region number discriminator, a target speed setting means and a filling yarn selecting means.

5. A loom speed controlling apparatus which comprises:

a data memory for storing the maximum allowable loom speed values in correlation with types of various filling yarns, and a discriminating means for determining the maximum allowable speed value from said data memory as the target speed of a driving motor of the loom in response to an external weft selection signal.

6. A loom speed controlling apparatus according to claim 2 which comprises a multi-color weft inserting device having an electronic dobby from which an external weft selection signal is supplied, said electronic dobby outputting a signal for a specified classification of the weft corresponding to advance of weaving, and said discriminating means including means for obtaining from said data memory said maximum allowable loom speed corresponding to the weft selection signal supplied form the electronic dobby.

7. A loom speed controlling apparatus according to claim 6 wherein said data memory includes means for storing only the maximum allowable speed values corresponding to filling yarn types.

* * * * *